US006227879B1

(12) United States Patent
Dong

(10) Patent No.: US 6,227,879 B1
(45) Date of Patent: May 8, 2001

(54) ELECTRICAL CONNECTOR WITH GROUNDING SHROUD HAVING BOARD-LOCKS FOR GRASPING A CIRCUIT BOARD

(75) Inventor: Shun-Chi Dong, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/469,154

(22) Filed: Dec. 21, 1999

(51) Int. Cl.[7] ..... H01R 13/73

(52) U.S. Cl. ..... 439/92; 439/567; 439/607; 439/159

(58) Field of Search ..... 439/607–610, 439/567, 571, 572, 160, 159, 92, 95

(56) References Cited

U.S. PATENT DOCUMENTS 5,192,228 * 3/1993 Collins et al. ..... 439/567
5,470,259 * 11/1995 Kaufman et al. ..... 439/607
5,772,453 * 6/1998 Tan et al. ..... 439/567
5,885,100 * 3/1999 Talend et al. ..... 439/607
5,938,473 * 8/1999 Nishio et al. ..... 439/567
6,012,948 * 1/2000 Wu ..... 439/567

* cited by examiner

*Primary Examiner*—Gary F. Paumen
(74) *Attorney, Agent, or Firm*—Wei Te Chung

(57) ABSTRACT

An electrical connector of the present invention includes a frame, a plurality of contacts received in the frame and a grounding shroud fixed and covering on the frame. The grounding shroud forms a number of board locks downwardly extending beyond a mounting face of the frame. When the electrical connector is positioned on a circuit board, the board locks fixedly engage with the circuit board, thereby preventing relative movement between the electrical connector and the circuit board during soldering of the contacts to the circuit board.

1 Claim, 6 Drawing Sheets

ELECTRICAL CONNECTOR WITH GROUNDING SHROUD HAVING BOARD-LOCKS FOR GRASPING A CIRCUIT BOARD

BACKGROUND OF THE INVENTION

1. Field of the invention

The present invention relates to a connector, and particularly to a connector with a grounding shroud having means for fixedly engaging with a circuit board.

2. Prior Art of the invention

Electrical connectors are usually used to establish electrical connection between an electronic component and a circuit board. However, electromagnetic interference, such as cross talk, commonly occurs during high speed signal transmission. Thus, conductive grounding shrouds are often used to shield the connector and must be electrically connected to ground in the circuit board on which the connector is mounted to overcome such problems. Such grounding shrouds and related connectors are respectively shown in FIGS. 5 and 6.

As shown in FIG. 5, a first conventional connector 5 comprises an insulative housing 50, a plurality of contacts 51 received in the housing 50, a grounding shroud 53 covering the housing 50 and a shield 52 positioned below the housing 50. The housing 50, the grounding shroud 53 and the shield 52 are joined together by engaging means thereof as well as a pair of bolts 57. A card ejector 58 is positioned at a side of the shield 52 for manual ejection of a memory card therefrom. When the assembled connector 5 is mounted onto a circuit board 6, a pair of board-locks 55 secured in the housing 50 are available to reliably secure the connector 5 to the circuit board 6 through a pair of through-holes 61 defined in the circuit board 6 so that it is unmovable during soldering. However, the pair of board-locks 55 increases the cost of the connector and enlarges the elongate dimension of the connector.

Referring to FIG. 6, a second conventional connector 70 disclosed in U.S. Pat. No. 5,470,259 comprises an insulative housing 72, a plurality of contacts 74 received in the housing 72 and a grounding shroud 76 covering the housing 72. The grounding shroud 76 comprises a plurality of terminal members 78 adapted to be electrically connected to a circuit board 80 to transmit electromagnetic signal therethrough. However, the grounding shroud 76 still does not provide a method of securing the second conventional connector 70 onto the circuit board 80, so external retaining elements are still necessary to secure the second conventional connector onto the circuit board 80. Hence, an improved electrical connector is required to overcome the disadvantages of the prior art.

BRIEF SUMMARY OF THIS INVENTION

An object of the present invention is to provide an electrical connector with a grounding shroud having locking means for fixedly engaging the grounding shroud and the electrical connector onto a circuit board.

To fulfil the above object, an electrical connector of the present invention includes a frame, a plurality of contacts received in the frame and a grounding shroud fixed on and covering the frame. The grounding shroud forms a number of protrusions each having a board-lock construction, downwardly extending beyond a mounting face of the frame. When the electrical connector is positioned on a circuit board, the protrusions fixedly engage with the circuit board, thereby preventing relative movement between the electrical connector and the circuit board during soldering of the contacts to the circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
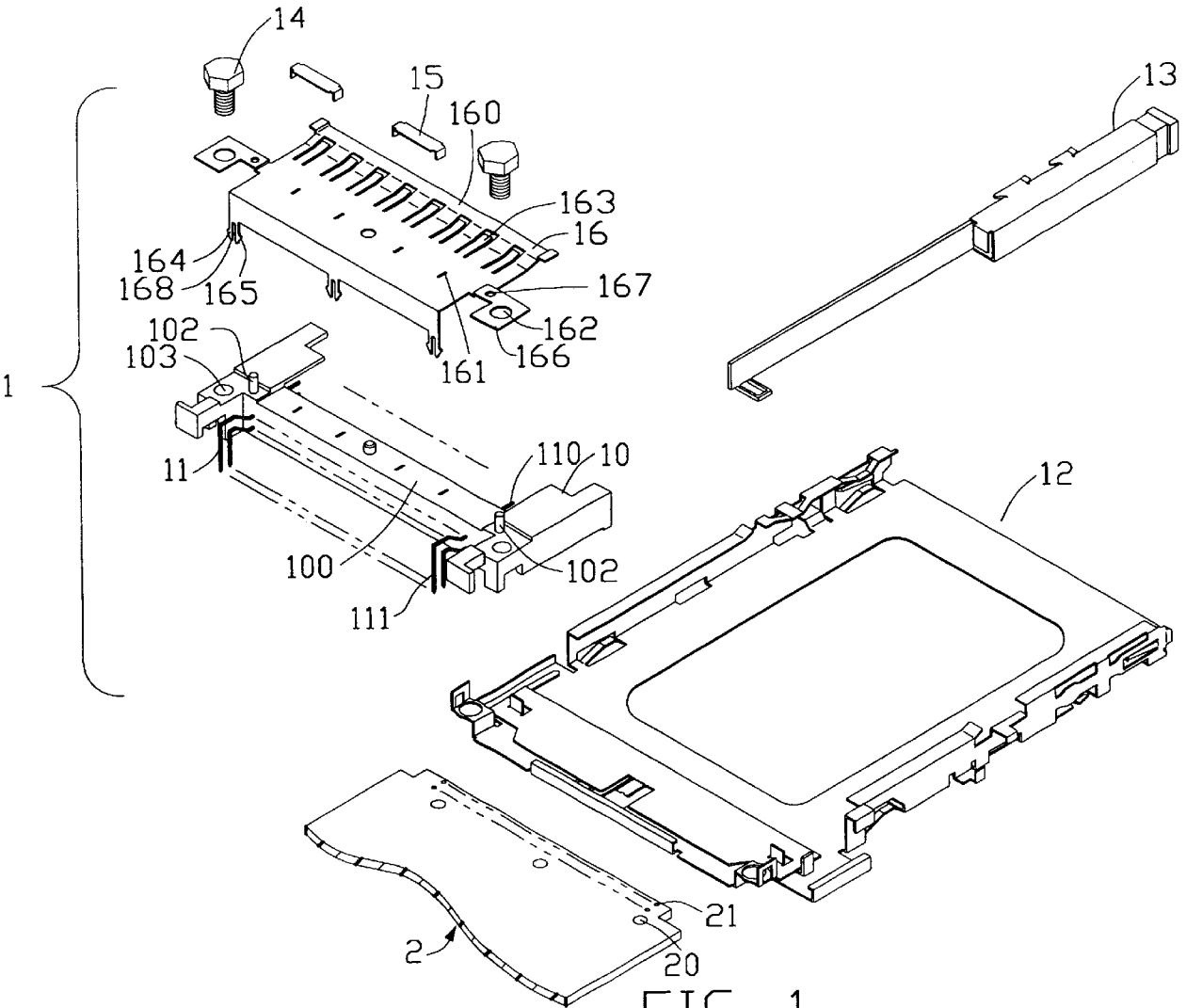
FIG. 1 is a partially exploded view of an electrical connector of the present invention.

Referring to FIG. 1, an electrical connector 1 of the present invention comprises an insulative frame 10, a plurality of conductive contacts 11 received in the flame 10, a shield 12 upwardly supporting the frame 10, a card ejector 13 positioned in a side of the shield 12 and a grounding shroud 16 covering a top face 100 of the frame 10. The frame 10 forms a pair of position poles 102 and defines a pair of position openings 103 in the top face 100 thereof. Each contact 11 comprises a first end 111 and a second end 110 extending beyond the frame 10 in opposite directions for electrically mounting to a circuit board 2 and for mating with an inserted electrical component (not shown), respectively. The grounding shroud 16 comprises a plate body 160 and a plurality of protrusions 164 extending beyond the vertical wall of the plate body 160 for fixedly engaging with the circuit board 2. The plate body 160 comprises a pair of tabs 166 at opposite side edges thereof, each of which defines a first through-hole 167 and a second through-hole 162 complementary to the position pole 102 and the position opening 103 of the frame 10, respectively. The plate body 160 further comprises a plurality of spring fingers 163 that are electrically connectable to ground means of the inserted electrical component. Each protrusion 164 has a board-lock construction, defining a slot 168 therein and forming an engaging bar 165 at each of two opposite edges thereof.

Figure 2:
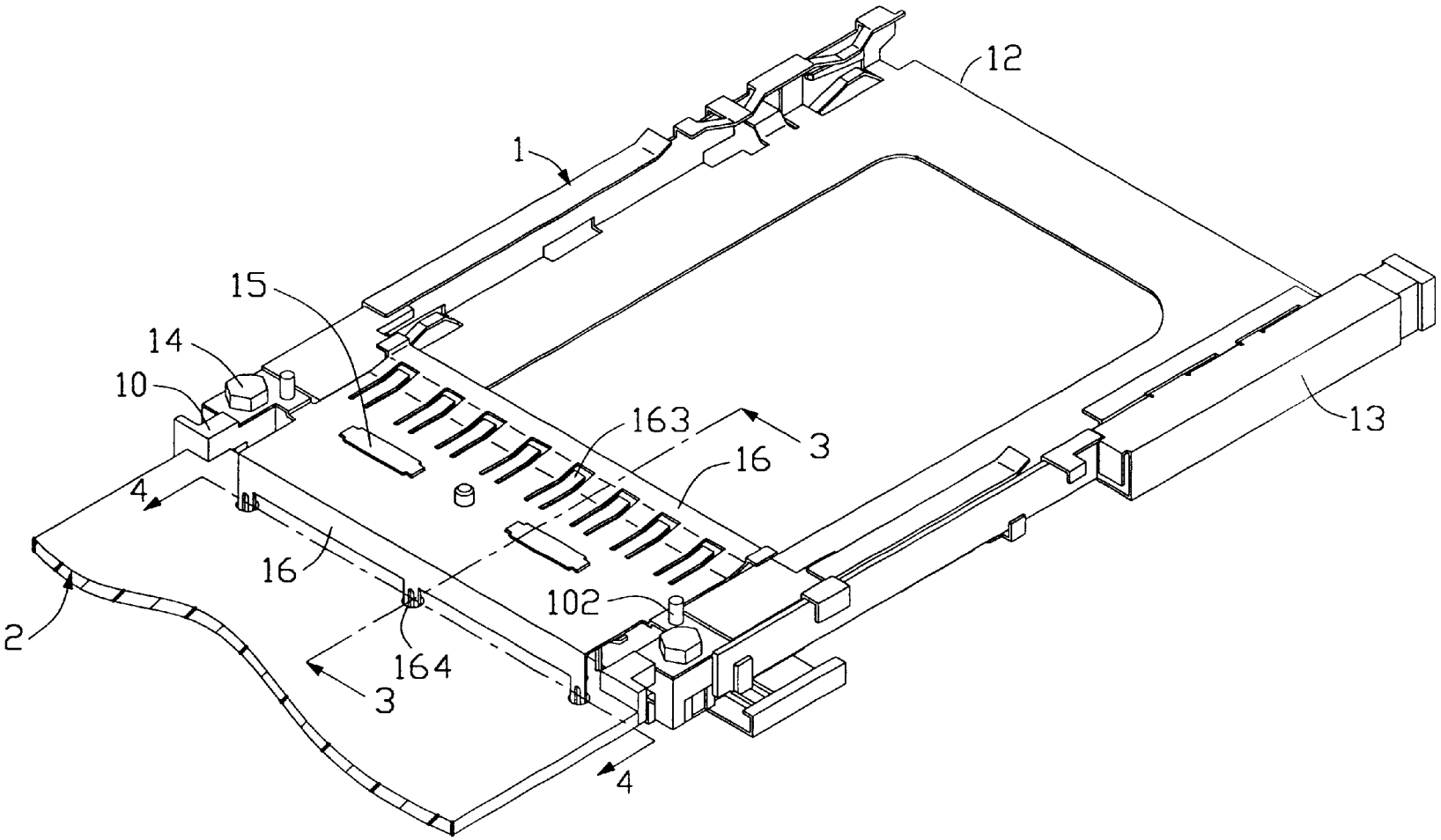
FIG. 2 is an assembled view of FIG. 1.
Figure 3:
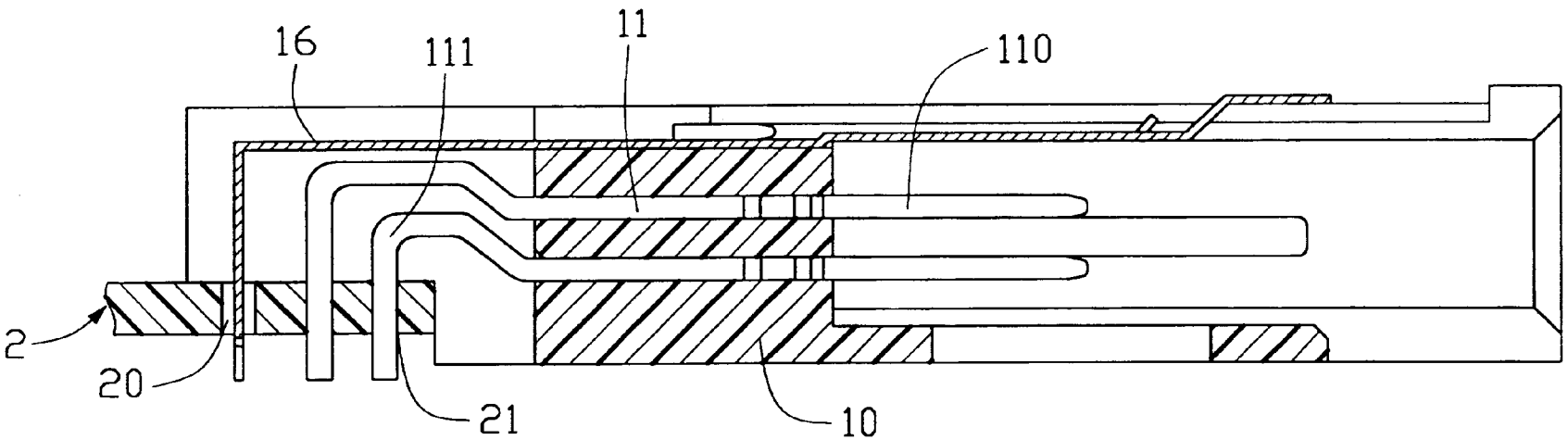
FIG. 3 is a cross-sectional view of the electrical connector taken along line 3—3 of FIG. 2.
Figure 4:
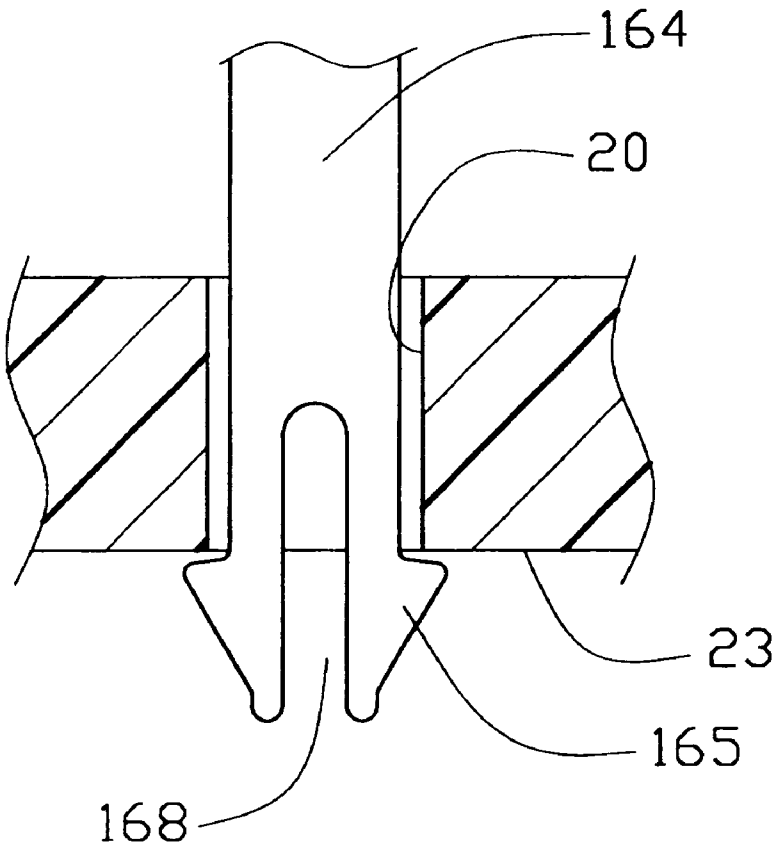
FIG. 4 is a partial and enlarged cross-sectional view of the electrical connector taken along line 4—4 of FIG. 2.
Figure 5:
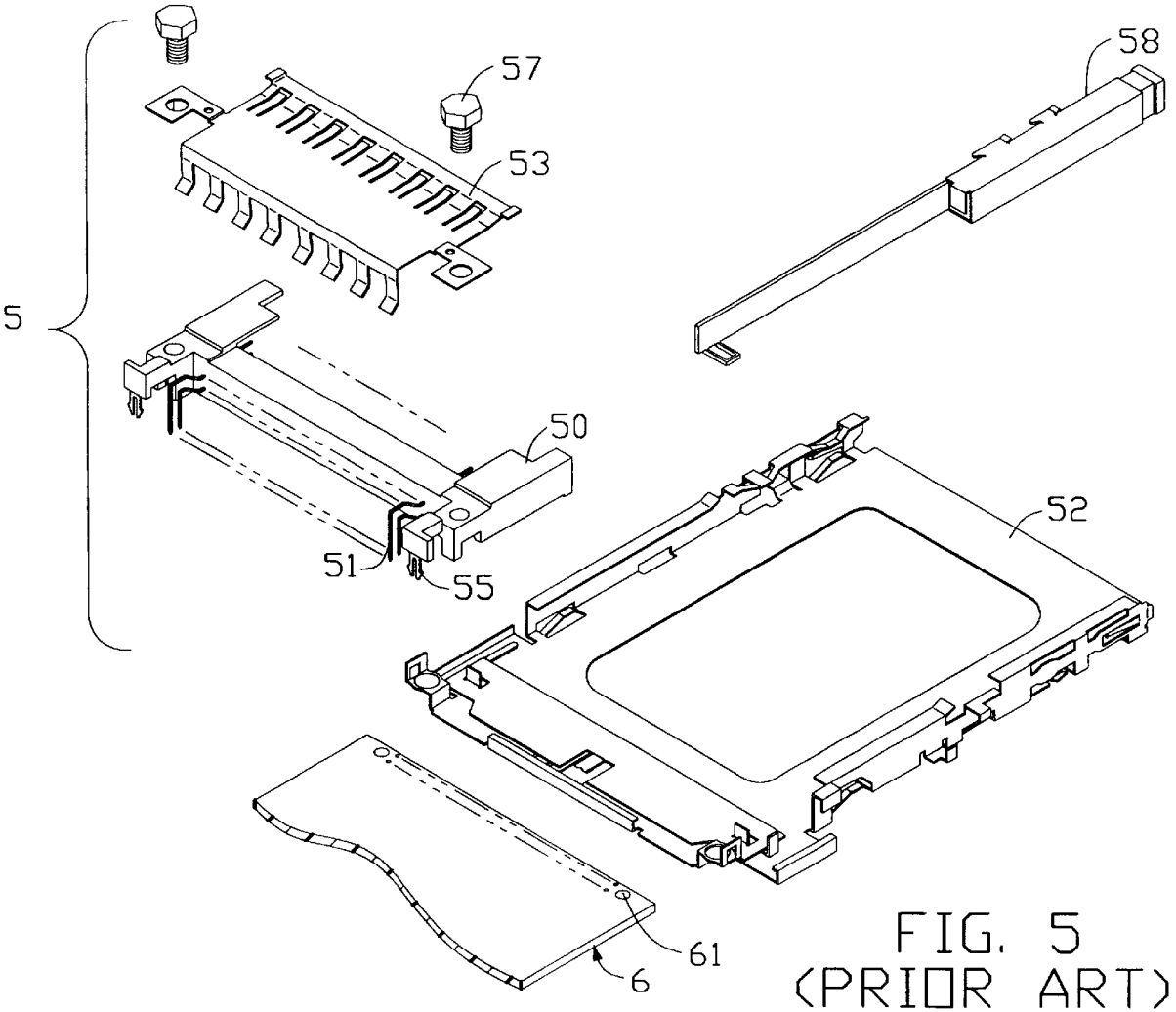
FIG. 5 (PRIOR ART)
FIG. 5 is a partially exploded view of a first conventional electrical connector.
Figure 6:
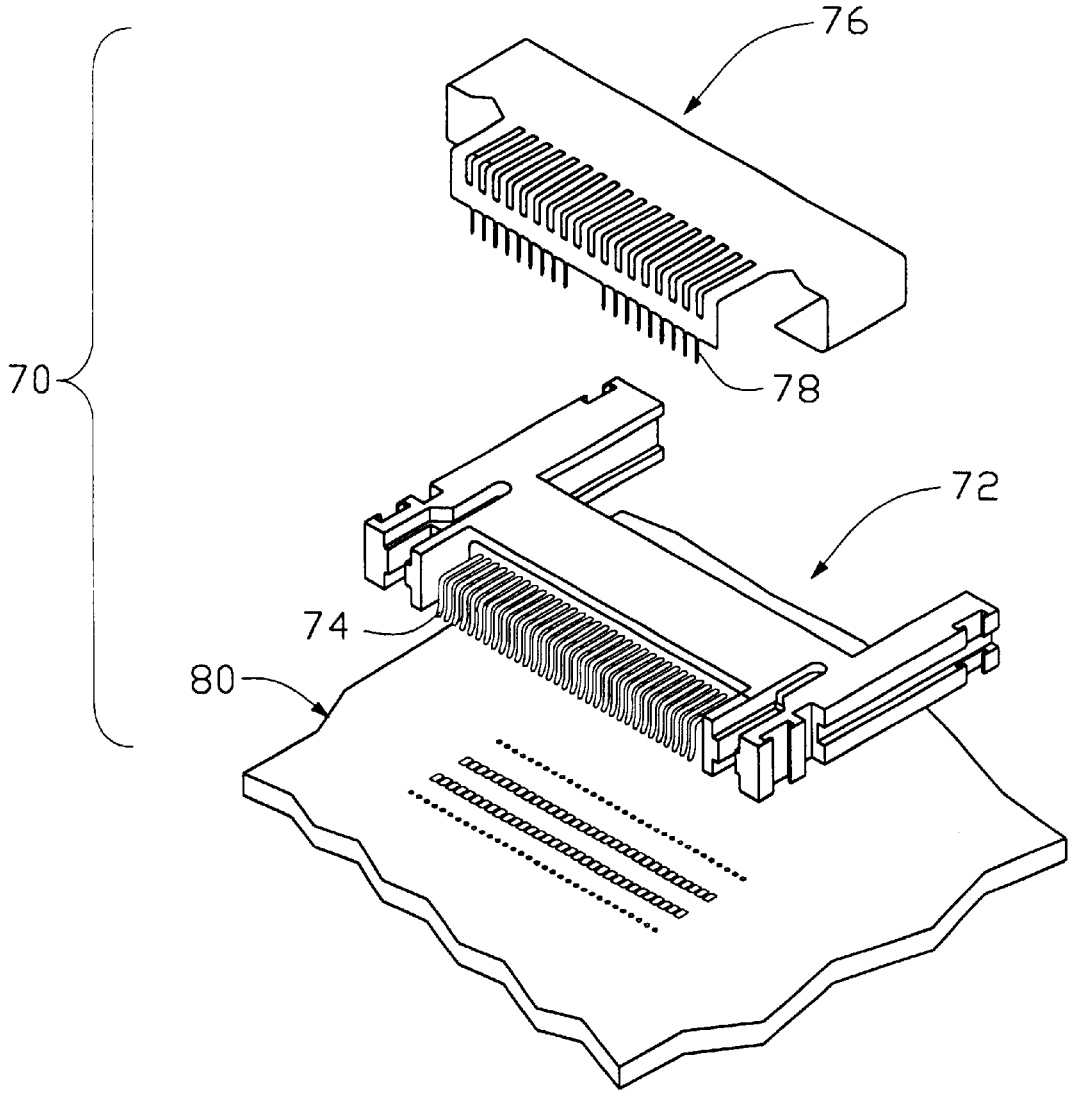
FIG. 6 (PRIOR ART)
FIG. 6 is an partially exploded view of a second conventional electrical connector.

In assembly, also referring to FIGS. 2–4, the grounding shroud 16 is downwardly positioned on the top face 100 of the frame 10 with the pair of first through-holes 167 receiving the pair of position poles 102 of the frame 10. Two retainers 15 are then fixed to the frame 10 through slits 161 defined in the grounding shroud 16 to further secure the grounding shroud 16 on the frame 10. The assembly of the grounding shroud 16 and the frame 10 is then positioned on the shield 12 and two bolts 14 are used to join the assembly and the shield 12 through the pair of second through-holes 162 and the pair of position openings 103 of the frame 10.

When the electrical connector 1 is mounted onto the circuit board 2, the first ends 111 of the plurality of contacts 11 are extended through a plurality of passageways 21 in the circuit board 2. The protrusions 164 are fixedly received in position holes 20 of the circuit board 2 with the engaging bars 165 thereof bearing against a bottom face 23 of the circuit board 2 whereby relative movement between the electrical connector 1 and the circuit board 2 is prevented. Therefore, the connector 1 can be reliably connected to the circuit board 2 by soldering.

The advantage of the present invention is that the grounding shroud 16 fulfills the function of grasping the circuit board when it is mounted thereon as well as its function of providing a grounded shield. Therefore, extra retaining elements, such as board-locks or screw bolts, are omitted and the connector 1 is manufactured at a lower cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical assembly comprising:

an electrical connector positioned on a printed circuit board, said connector including:

an insulative frame;

a plurality of contacts extending through said frame in a front-to-back direction;

a metal shield positioned under the frame with an ejection mechanism therein;

a metal grounding shroud attached to the frame, said shroud defining a vertical wall covering vertical sections of the contacts therein, said shroud further including a plurality of board locks integrally extending downwardly from the vertical wall;

said printed circuit board defining a plurality of passageways therein adjacent to a front edge thereof, and a plurality of board lock holes spaced relatively farther from said front edge than said passageways are; wherein the vertical sections of the contacts extend through the corresponding passageways, respectively, and the board locks respectively extend through the corresponding board lock holes each with an engaging bar substantially latchably engaged with the printed circuit board at the corresponding board lock hole.

* * * * *